US005217194A

United States Patent [19]

Brownell

[11] Patent Number: 5,217,194

[45] Date of Patent: Jun. 8, 1993

[54] YARD SWING STABILIZER APPARATUS

[76] Inventor: Hugh L. Brownell, 3325 Avenue I, Council Bluffs, Iowa 51501

[21] Appl. No.: 848,072

[22] Filed: Mar. 9, 1992

[51] Int. Cl.[5] ..... F16M 13/00

[52] U.S. Cl. ..... 248/156; 52/160; 135/118; 248/530; 411/82; 411/359; 411/447

[58] Field of Search ..... 248/156, 530, 532, 533; 135/118; 52/160; 411/82, 257, 258, 930, 357, 358, 359, 446, 447, 448

[56] References Cited

U.S. PATENT DOCUMENTS

| | | | |
|---|---|---|---|
| 697,031 | 4/1902 | Snook | 52/160 |
| 707,683 | 8/1902 | Farwell | 52/160 |
| 727,335 | 5/1903 | Fisher | 52/160 |
| 1,189,787 | 7/1916 | Caddy | 52/160 |
| 1,548,456 | 8/1925 | Goodman | 411/359 |
| 1,940,430 | 12/1933 | Morterra | 52/160 |
| 3,512,319 | 5/1970 | Piancentino | 52/160 |
| 3,974,604 | 8/1976 | Conn et al. | 52/160 |
| 4,657,460 | 4/1987 | Bien | 411/258 |
| 5,010,698 | 4/1991 | Hugron | 135/118 X |

FOREIGN PATENT DOCUMENTS

| | | | |
|---|---|---|---|
| 370594 | 4/1932 | United Kingdom | 52/160 |

*Primary Examiner*—David L. Talbott
*Attorney, Agent, or Firm*—Leon Gilden

[57] ABSTRACT

Support tubes of an associated yard swing arrangement are mounted to stabilizer apparatus, including an upper tube portion coaxially mounted to a lower tube portion. The lower tube portion includes a "V" shaped anchor plate member arranged for projection into an underlying ground surface. A modification of the invention includes anchor rods pivotally mounted relative to an inner tube arranged for projection through slots of an outer tube for securement to an underlying ground surface in the anchoring of the yard swing structure to the inner tube.

2 Claims, 4 Drawing Sheets

YARD SWING STABILIZER APPARATUS

BACKGROUND OF THE INVENTION

1. Field of the Invention

The field of invention relates to yard swing arrangements, and more particularly pertains to a new and improved yard swing stabilizer apparatus wherein the same is arranged for fixedly mounting yard swings to an underlying ground surface.

2. Description of the Prior Art

Yard swings of various types are utilized in the prior art and are typically positioned upon a supporting ground surface, or alternatively are mounted within concrete anchors and the like. The instant invention attempts to overcome deficiencies of the prior art by providing an anchor structure arranged for the convenient and efficient mounting of a yard swing arrangement relative to the associated ground surface. Yard swing structure in the prior art is exemplified in U.S. Pat. Nos. 3,427,024; 4,706,952; 3,599,973; and 4,537,392.

Accordingly, it may be appreciated that there continues to be a need for a new and improved yard swing stabilizer apparatus as set forth by the instant invention which addresses both the problems of ease of use as well as effectiveness in construction which fixedly secures a yard swing relative to an underlying ground surface and in this respect, the present invention substantially fulfills this need.

SUMMARY OF THE INVENTION

In view of the foregoing disadvantages inherent in the known types of yard swing apparatus now present in the prior art, the present invention provides a yard swing stabilizer apparatus wherein the same is arranged for mounting to stabilizer structure of the invention projected into the ground surface supporting the yard swing arrangement. As such, the general purpose of the present invention, which will be described subsequently in greater detail, is to provide a new and improved yard swing stabilizer apparatus which has all the advantages of the prior art yard swing apparatus and none of the disadvantages.

To attain this, the present invention provides support tubes of an associated yard swing arrangement mounted to stabilizer apparatus, including an upper tube portion coaxially mounted to a lower tube portion. The lower tube portion includes a "V" shaped anchor plate member arranged for projection into an underlying ground surface. A modification of the invention includes anchor rods pivotally mounted relative to an inner tube arranged for projection through slots of an outer tube for securement to an underlying ground surface in the anchoring of the yard swing structure to the inner tube.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved yard swing stabilizer apparatus which has all the advantages of the prior art yard swing apparatus and none of the disadvantages.

It is another object of the present invention to provide a new and improved yard swing stabilizer apparatus which may be easily and efficiently manufactured and marketed.

It is a further object of the present invention to provide a new and improved yard swing stabilizer apparatus which is of a durable and reliable construction.

An even further object of the present invention is to provide a new and improved yard swing stabilizer apparatus which is susceptible of a low cost of manufacture with regard to both materials and labor, and which accordingly is then susceptible of low prices of sale to the consuming public, thereby making such yard swing stabilizer apparatus economically available to the buying public.

Still yet another object of the present invention is to provide a new and improved yard swing stabilizer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
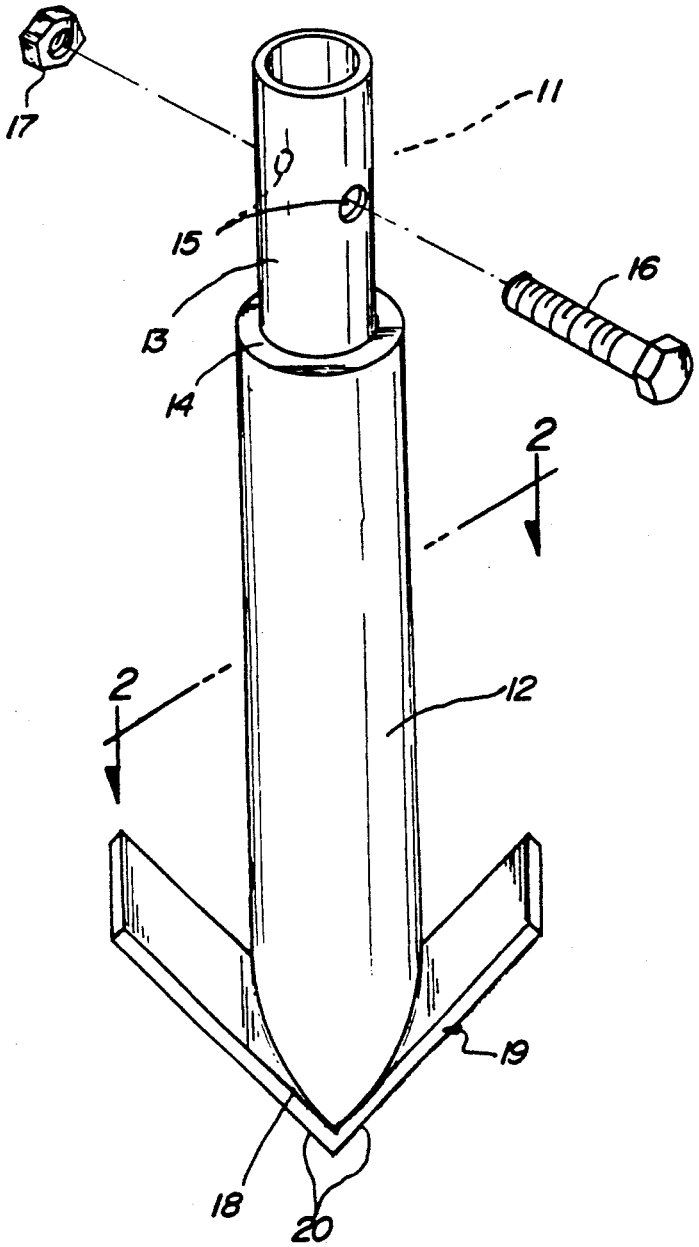
FIG. 1 is an isometric illustration of the instant invention.

With reference now to the drawings, and in particular to FIGS. 1 to 7 thereof, a new and improved yard swing stabilizer apparatus embodying the principles and concepts of the present invention and generally designated by the reference numerals 10 and 10*a* will be described.

Figure 2:
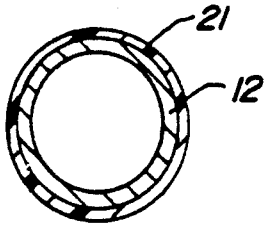
FIG. 2 is an orthographic view, taken along the lines 2—2 of FIG. 1 in the direction indicated by the arrows.
Figure 3:
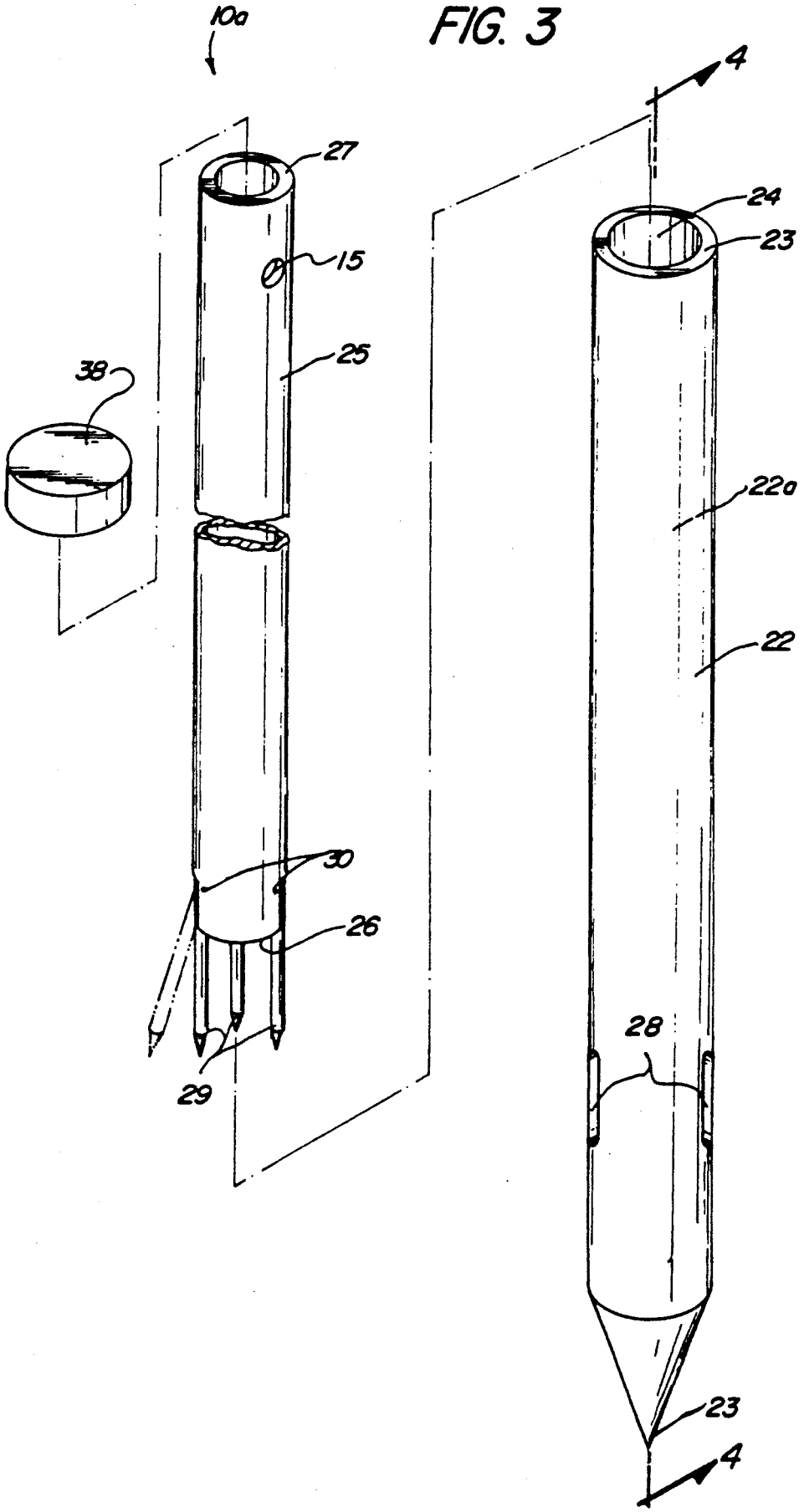
FIG. 3 is an isometric exploded illustration of a modification of the invention.
Figure 4:
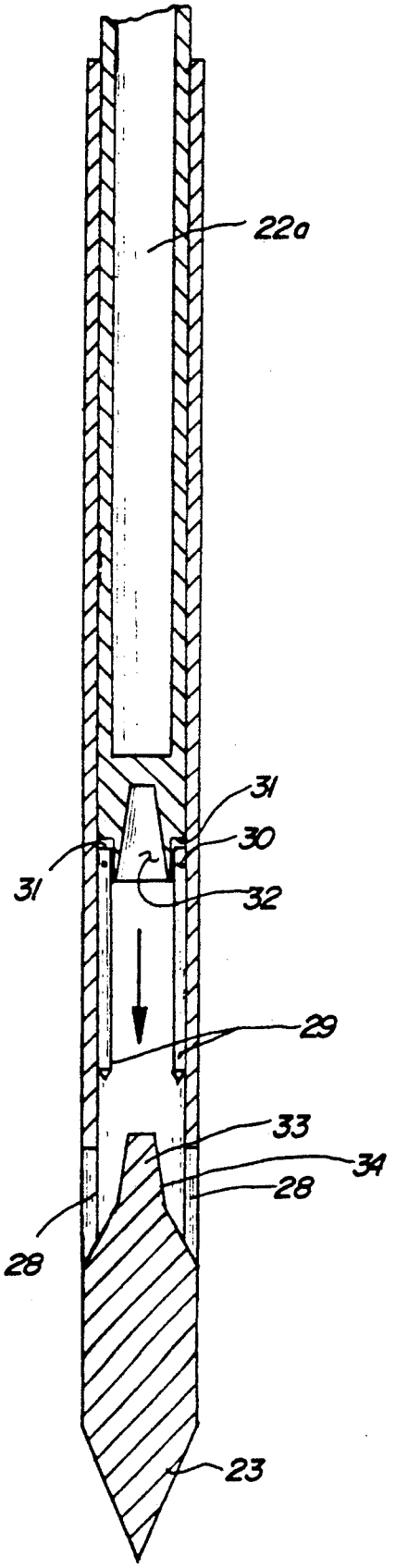
FIG. 4 is an orthographic view, taken along the lines 4—4 of FIG. 3 in the direction indicated by the arrows.
Figure 5:
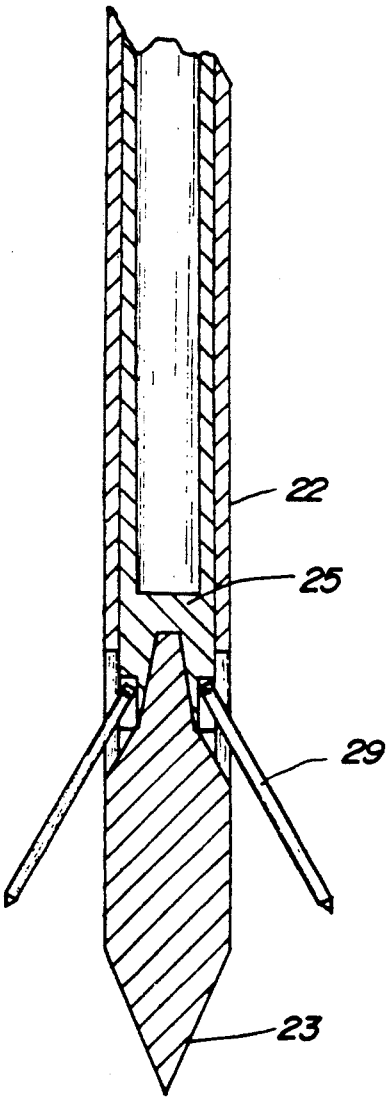
FIG. 5 is an orthographic cross-sectional illustration of the invention of FIG. 4 in an assembled configuration.

More specifically, the yard swing stabilizer apparatus 10 of the instant invention essentially comprises the organization arranged for mounting a conventional yard swing arrangement, such as set forth in the U.S. Pat. No. 3,427,042 incorporated herein by reference, relative to an underlying ground surface. To this end, the yard swing stabilizer apparatus includes a tubular swing leg 11 of a conventional yard swing arrangement mounted onto a cylindrical first tube body 12 defined by a first diameter, and more specifically, to an annular planar abutment ledge 14 at an upper distal end of the first support body 12. A cylindrical second support body 13 integral with the first support body 12 extends upwardly and coaxially relative to the first support body and is defined by a second diameter less than the first diameter. Diametrically aligned fastener receiving bores 15 are directed through the second support body 13 to receive a fastener rod 16 therethrough cooperative with securement nut 17 that is in turn directed through the tubular swing leg 11. A first support body lower end portion 18 is integrally mounted medially of a "V" shaped plate member 19 whose anchor plates 20 are canted upwardly and spaced from the first support body 12, with the anchor plates 20 integrally mounted relative to one another defining an acute include angle therebetween, with the first support body lower end portion 18 received within a junction of the anchor plate 20. The FIG. 2 illustrates the use of a polymeric coating 21 utilized by the first support body 12 to minimize corrosion and the like relative to the structure during use.

The FIGS. 3–7 illustrate a modified apparatus 10*a*, including a first support tube 22 formed with a conical pointed lower terminal end 23 and an upper end entrance opening 24 at its upper distal end. A second support tube 25 is slidably received within the first support tube 22 through the entrance opening 24 coaxially aligned with an axis 22*a* of the first support tube 22. The second support tube 25 includes a support tube lower end 26 and a support tube upper end 27. Further, a predetermined number of first support tube radial slots 28 arranged parallel through each other and directed through the wall of the first support tube 22 are parallel to the axis 22*a* adjacent the second support tube lower end 26. A like predetermined number of anchor rods 29, each of a first length, are pivotally mounted each about a pivot axle 30 that is spaced from the second support tube lower end 26 a second length less than the first length, with each of the anchor rods 29 received within an anchor rod recess 31, with each of the recesses 31 arranged parallel to the axis 22*a* (see FIG. 4 for example). A second support tube cavity 32 is directed into the second support tube 25 from the second support tube lower end 26 and complementarily receives a first support tube projection 33 projecting upwardly of the second support tube lower end 23 within the first support tube coaxially aligned with the axis 22*a*. A projection cam wall 34 is defined about the first support tube projection 33 to slidably receive the anchor rods 29 thereon, with the lower distal end of the cam wall 34 extending into the radial slots 28 to align and direct the rods 29 into a slot 28 when the second support tube 25 is directed into the first support tube 22.

Figure 6:
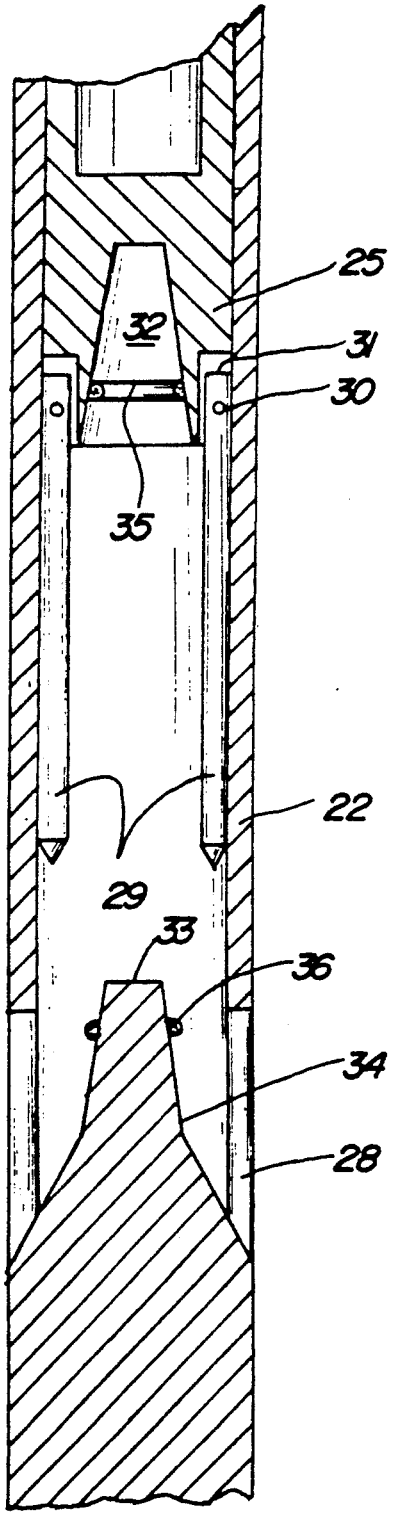
FIG. 6 is an orthographic cross-sectional illustration of the modification of the invention in the first raised positioned utilizing an adhesive interface.
Figure 7:
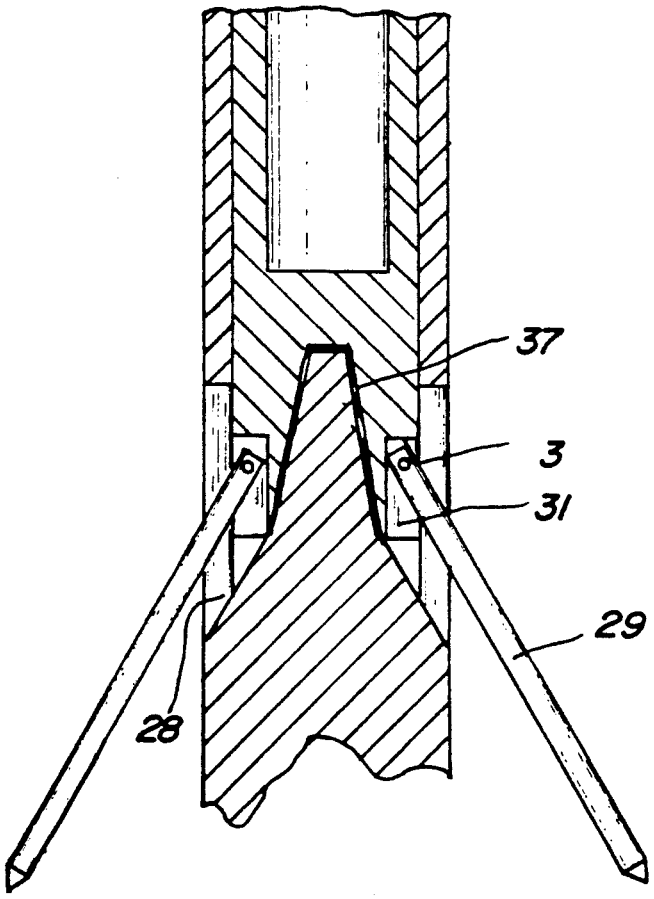
FIG. 7 is an orthographic cross-sectional illustration of the modification of the invention as set forth in FIG. 6, illustrating the adhesive interface in communication between the first and second support tubes.

To insure fixed assemblage of the first and second support tubes together, the FIGS. 6 and 7 illustrate the use of an epoxy resin ring 35 positioned within the second support tube cavity 32 cooperative with an epoxy resin hardener ring 36, whereupon projection of the second support tube within the first support tube and projection of the first support tube projection 33 within the second support tube cavity 32 effects mixing of the epoxy resin ring 35 and the epoxy resin hardener ring 36 to effect an adhesive layer 37 within the second support tube cavity 32 and about the first support tube projection 33 to secure the first support tube relative to the second support tube.

Further to protect the upper distal end 27 of the second support tube 25, a protective cap 38 is slidably received upon the second support tube upper end 27 to accommodate hammering of the second support tube when directed into the first support tube.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A yard swing stabilizer apparatus, comprising, a first cylindrical support tube, the first support tube including a conical lower terminal end, and an upper entrance opening, and a second support tube slidably and coaxially received within the first support tube through the entrance opening, the second support tube including a second support tube lower end and a second support tube upper end, and a predetermined number of first support tube radial slots directed through the first support tube adjacent the first support tube lower terminal end, wherein the radial slots are arranged parallel relative to one another and to an axis of the first support tube, and latch means mounted to the second support tube cooperative with the radial slots for projection through the radial slots upon projection of the second support tube within the first support tube, and the latch means includes a predetermined number of anchor rods pivotally mounted to the second support tube adjacent the second support tube lower end, each of the anchor rods is defined by a first length and each of the anchor rods pivotally mounted about a pivot axle mounted to the second support tube, wherein each of the pivot axles is spaced from the second support tube lower end a second length less than the first length, and each of the pivot axles are mounted within an anchor rod recess, each of the anchor rod recesses are parallel relative to one another and to the axis, and the second support tube includes a second support tube cavity coaxially aligned with the axis projecting into the second support tube from the second support tube lower end, and the first support tube including a first support tube projection positioned within the first support tube extending upwardly of the first support tube lower end, wherein the first support tube projection is complementarily received within the second support tube cavity, and the first support tube projection includes a projection cam wall in surrounding relationship relative to the first support tube projection, wherein the cam wall extends into the radial slots, and the second support tube cavity includes an epoxy resin ring mounted within the second support tube cavity, and the first support tube includes an epoxy resin hardener ring mounted in surrounding relationship about the cam wall for mixture with the epoxy resin ring upon projection of the second support tube within the first support tube.

2. An apparatus as set forth in claim 1 including a protective cap removably mounted to the second support tube upper end for affording protection to the second support tube upper end upon directing the second support tube into the first support tube.

* * * * *